United States Patent [19]

Akkerman

[11] 4,248,138

[45] Feb. 3, 1981

[54] FAIL SAFE LOCKING MECHANISM FOR FLUID OPERATED VALVE ACTUATOR

[75] Inventor: Neil H. Akkerman, Kingwood, Tex.

[73] Assignee: Baker CAC, Inc., Belle Chasse, La.

[21] Appl. No.: 944,050

[22] Filed: Sep. 19, 1978

[51] Int. Cl.[3] ..... F15B 15/26

[52] U.S. Cl. ..... 92/27; 92/166

[58] Field of Search ..... 92/23, 24, 26, 27, 28, 92/30, 5 L, 166, 5 R; 91/43, 44, 45

[56] References Cited

U.S. PATENT DOCUMENTS

| | | | |
|---|---|---|---|
| 2,221,121 | 11/1940 | Wallace | 92/24 |
| 2,434,828 | 1/1948 | Ashton | 92/24 |
| 2,568,561 | 9/1951 | Perdue | 92/5 R |
| 2,713,328 | 7/1955 | Driskel | 92/24 |
| 3,003,473 | 10/1961 | Ottoson | 92/5 R |
| 3,397,620 | 8/1968 | Skelten | 92/24 |

FOREIGN PATENT DOCUMENTS

| | | | |
|---|---|---|---|
| 573033 | 11/1945 | United Kingdom | 92/24 |

*Primary Examiner*—Abraham Hershkovitz

*Attorney, Agent, or Firm*—William C. Norvell, Jr.

[57] ABSTRACT

A fail safe mechanism is provided for locking an actuating piston rod of a fluid operated actuator in a selected axial position in the event of a failure, or significant decrease in, the fluid pressure applied to the actuator. Preferably, a secondary cylinder is provided within the actuator cylinder and is in fluid communication therewith. A piston in the secondary cylinder is biased toward a locking position by a spring and is shiftable toward a released position by the existence of a predetermined amount of fluid pressure in the main cylinder. An annularly extending locking mechanism is provided in surrounding relationship to the actuating piston rod and is radially movable into engagement with a locking shoulder on such piston rod when the rod is shifted to one of its selected axial positions by the application of fluid pressure to the cylinder. In its locking position, the locking piston prevents any radial outward movement of the annularly extending locking means and thus mechanically locks the actuating piston rod in its selected axial position.

1 Claim, 4 Drawing Figures

FAIL SAFE LOCKING MECHANISM FOR FLUID OPERATED VALVE ACTUATOR

BACKGROUND OF THE INVENTION

1. Field of the Invention

The invention relates to a novel locking mechanism for locking the piston rod of a fluid responsive valve actuator in at least one of first and second positions respectively corresponding to the open and closed positions of a valve member manipulated by the actuator.

2. Description of the Prior Art

In oil fields, pipe lines, and refineries there has been a considerable need for a fluid actuated valve actuator which, in the event of an emergency causing the reduction or loss of control pressure supplied to the actuator, would be mechanically locked in the position it held prior to the occurrence of the emergency. Depending upon the particular application, it may be desirable that the fluid operated valve actuator be mechanically locked in either its open or its closed position. More importantly, there are a significant number of valves requiring cycling operations between an open and closed position and it is desirable that such valves be locked in the same position as existed prior to the occurrence of the particular emergency. In a more common parlance, it is therefore desirable that a valve actuator be capable of being locked in an up position, a down position, or either an up or down position in the event of loss of, or reduction in, control pressure supplied to such valve actuator.

SUMMARY OF THE INVENTION

The fail safe mechanism of this invention may be applied to any type of fluid actuator, either hydraulic or pneumatic, which incorporates a cylinder to which fluid pressure is applied, and a piston axially shiftable within such cylinder by the applied pressure. Customarily, the piston has at least one axially extending rod portion extending outwardly through an annular seal in the end wall of the cylinder to provide a means for connecting the pistion rod to a valve or other mechanism requiring actuation. A secondary cylinder chamber is provided within the main cylinder and in fluid communication with the main cylinder chamber. A locking piston is mounted for reciprocal movements in the secondary cylinder respectively between a locking position and a release position. The application of fluid pressure to the main cylinder normally moves the locking piston to its release position. Resilient means, such as a spring, is provided to bias the locking piston to its locking position so that any failure of pressure in the main cylinder or significant reduction in such pressure will cause the locking piston to move to its locking position.

The actual mechanical locking of the piston rod in a selected axial position is accomplished by an annularly disposed array of either locking segments or locking balls which are radially shiftable to move into locking engagement with a shoulder provided on the main piston rod when such rod is in one of its desired axial positions. The locking elements may be moved radially inwardly either by resilient means or by the camming action of the locking piston as it moves to its locking position.

In the event of a loss of fluid pressure in the main cylinder, or a significant decrease in such pressure, the annular array of locking elements move into engagement with the locking shoulder on the main piston rod and are retained in such position by the movement of the locking piston to its locking position under the influence of its biasing spring.

Obviously, such locking mechanism may be applied to a single acting valve actuator to hold the actuator in an up position, or a down position. By providing two locking mechanisms within the main cylinder, which may be located on opposite sides of the piston, a double acting actuator may be provided with fail safe locking in both its up and down positions.

DESCRIPTION OF THE PREFERRED EMBODIMENTS

Figure 1:
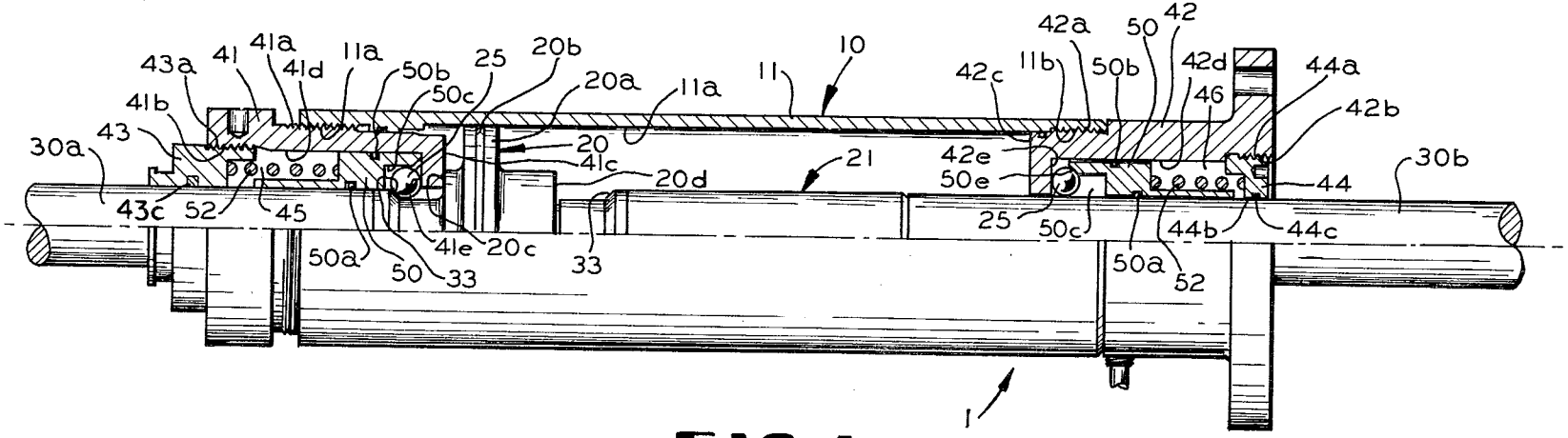
FIG. 1 is an elevational view, with a portion thereof shown in vertical section, of a double acting hydraulic cylinder incorporating the locking mechanisms of this invention, with the piston of the cylinder shown in one of its two axial positions.

A fluid operated actuating device 1 is shown in all of the FIGS. as incorporating a hollow cylinder portion 10 cooperating in slidable relationship with a piston 20 which is mounted on and secured to a piston rod 21 in any conventional manner.

While in all of the illustrated embodiments, a double acting piston and cylinder unit is illustrated, wherein fluid pressure is selectively applied to either side of the piston 20 and the extreme axial ends 30*a* and 30*b* of the piston rod 21 respectively pass outwardly of the end walls of the device through suitable annular seals, those skilled in the art will readily recognize that the principles of this invention are equally applicable to a single acting piston and cylinder arrangement wherein pressure is applied to only one side of the piston and the piston rod extends axially through only one end wall of the cylinder. Thus, the invention is equally applicable to both single acting actuators and double acting actuators.

The cylinder 10 comprises a main tubular body portion 11 having internally threaded end portions 11*a* and 11*b* for reception of threaded portion 41*a* and 42*a* respectively of hollow bushings 41 and 42 which are inserted within the ends of the cylinder 10. The axially outer end of the bushing 41 is internally threaded to receive an externally threaded portion 43*a* of an end wall bushing 43. Likewise, the bushing 42 is internally threaded as indicated at 42*b* to receive the externally threaded portion 44*a* of the end wall bushing 44. The cylindrical bores 44*b* of the end wall bushing 44 incorporate a conventional seal 44*c* which sealingly engages the rod portion 21*b* of the piston assembly 20. Similarly, a seal 43*c* provided in the bore 43*b* of the opposite end wall bushing 43 sealingly engages the rod portion 30*a* of the piston rod 21.

The piston 20 includes a head portion 20*a* incorporating a suitable seal 20*b* which slidably and sealably engages the interior wall 11*a* of the cylinder tube 11. Pressured fluid may be supplied through conventional fittings to the interior of the cylinder 10 on either side of the piston 20 and thus the piston assembly 20 may be shifted axially between either of two selected axial positions respectively determined by the abutment of a shoulder 20*c* provided on the piston head 20 with an interiorly projecting radial wall 41*c* provided on the bushing 41 (see FIG. 1), and by the shoulder 20*d* abutting a similar interiorly projecting radial wall 42*c* provided on the bushing 42. (See FIG. 2). Interiorly projecting walls 41*c* and 42*c* are not in sealing engagement with the adjacent portions of the piston rods 30*a* and 30*b* respectively, hence these interiorly projecting walls each define annular secondary cylinder chambers 45 and 46, respectively, which are in fluid communication with the interior of the main cylinder 11.

Within such secondary cylinders, identical annular piston elements 50 are respectively mounted for sliding engagement relative to the interior cylindrical walls 41*d* and 42*d* of the respective end bushings 41 and 42. Pistons 50 are provided with internal seals 50*a* respectively engaging the adjacent surfaces of the piston rod 30*a* and 30*b* and external seals 50*b* respectively engaging the internal surfaces 41*d* and 42*d* of the end bushings 41 and 42. Thus, when pressure is applied to one side of the piston 20, causing it to move to the left as viewed in FIG. 1, then the piston 50, mounted in secondary cylinder chamber 46, is shifted axially to the right by the same fluid pressure applied to the main piston 20. This axially outward position, illustrated in FIG. 1, will hereinafter be referred to as the release position.

As the piston 20 approaches its extreme lefthand position, as illustrated in FIG. 1, the piston 50, which is mounted in the secondary cylinder chamber 45, remains in its illustrated right or inward position due to the influence of an axially disposed biasing spring 52. This position of each piston 50 is hereinafter referred to as the locking position of the locking pistons 50. When fluid pressure is applied to the interior of the cylinder 10 on the opposite side of the piston head 20*a*, the positioning of the locking pistons 50 are reversed and the piston 50 disposed in the secondary cylinder chamber 45 is moved axially outwardly to its release position, while the piston 50 disposed in the secondary cylinder chamber 46 is maintained in the axially inward locking position by its biasing spring 52.

A pair of locking shoulders 33 are respectively provided on rod portions 30*a* and 30*b* in axially spaced relationship on the piston rod 21 and on opposite sides of the piston head 20*a*. Locking shoulders 33 are axially positioned so as to be respectively adjacent the inner ends of the locking pistons 50 when the piston unit 20 is in one or the other of its two extreme axial positions.

Two annular arrays of locking elements 25 are provided which respectively cooperate with the locking shoulders 33 to secure the piston assembly 20 in one of its extreme axial positions whenever there is a loss of, or a significant decrease in, pressure applied to the fluid pressure actuator 10.

Figure 2:
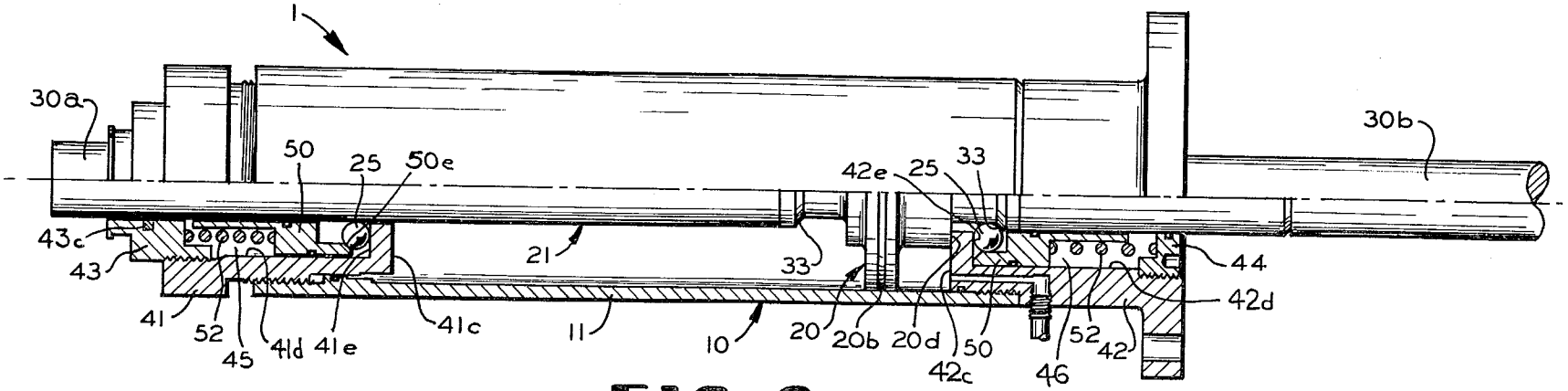
FIG. 2 is a view similar to FIG. 1, but showing the piston in the other of its axial positions.

In the modification of this invention illustrated in FIGS. 1 and 2, the locking elements 25 comprise an annular row of balls. One set of such balls are retained within an annular chamber defined by a recess 50*c* provided on the adjacent portion of the locking piston 50 and the inner wall 41*e* of the internally projecting radial flange 41*c* provided on the cylinder bushing 41. At the other end of the cylinder, the inner surface 42*e* of the internally projecting radial flange 42*d* cooperates with the piston recess 50*c* to provide a holding chamber for the other set of locking balls 25. The inner end face of each piston 50 is provided with an inclined surface 50*e* so as to urge the locking balls 25 inwardly into locking engagement with locking shoulder 23 on the piston assemblage. Each locking shoulder 33 is similarly inclined so as to cam the locking balls 25 out of its path any time that they are not restrained against radially outward movement by the locking piston 50.

From the foregoing description, it is therefore apparent that the annular array of locking balls 25 is freely radially shiftable into a locking engagement with the shoulder 33 provided on the piston rod 21. So long as pressure is applied to the actuator 10 on a particular side of the piston assemblage 20, the locking balls 25 on that side will be in their release position since the respective locking piston 50 will be forced axially to its release position, thus permitting the balls 25 to move radially outwardly and roll freely on the cylindrical surface of the piston rod 30*a* or 30*b*, as the case may be. When the piston assemblage 20 is in its extreme axial position, either to the left, as illustrated in FIG. 1, or to the right, as illustrated in FIG. 2, the loss of pressure within the actuator 10, or a significant decrease in such pressure, will cause a corresponding drop in pressure in the respective secondary cylinder 45 or 46 and will cause an axially inward shifting of the respective locking piston 50 under the bias of the respective spring 52. Such axial movement causes a radially inward displacement of the annular array of locking balls 25 into engagement with the adjacent one of the locking shoulders 33 provided on the piston rod portions 30*a* or 30*b*.

Thus, the piston rod assemblage 21 is physically locked in either of its extreme axial positions to which it is moved through the application of pressure to one side or the other of the piston head 20*a*. Hence, the occurrence of any emergency resulting in a loss of control pressure to actuator 10 or a significant decrease in such pressure, will not permit the fluid actuator 10 to move out of the position that it held at the time prior to the existence of the emergency.

Of course, the rod assemblage 21 may be unlocked from either of the locked positions by providing auxiliary or line pressure means to act on the portion of the piston 20 facing the respective locked assemblage 21, and the respective secondary piston 50 will be shifted axially away from the piston 20 to permit the balls 25 to become disengaged from the cammed shoulders 33.

Figure 3:
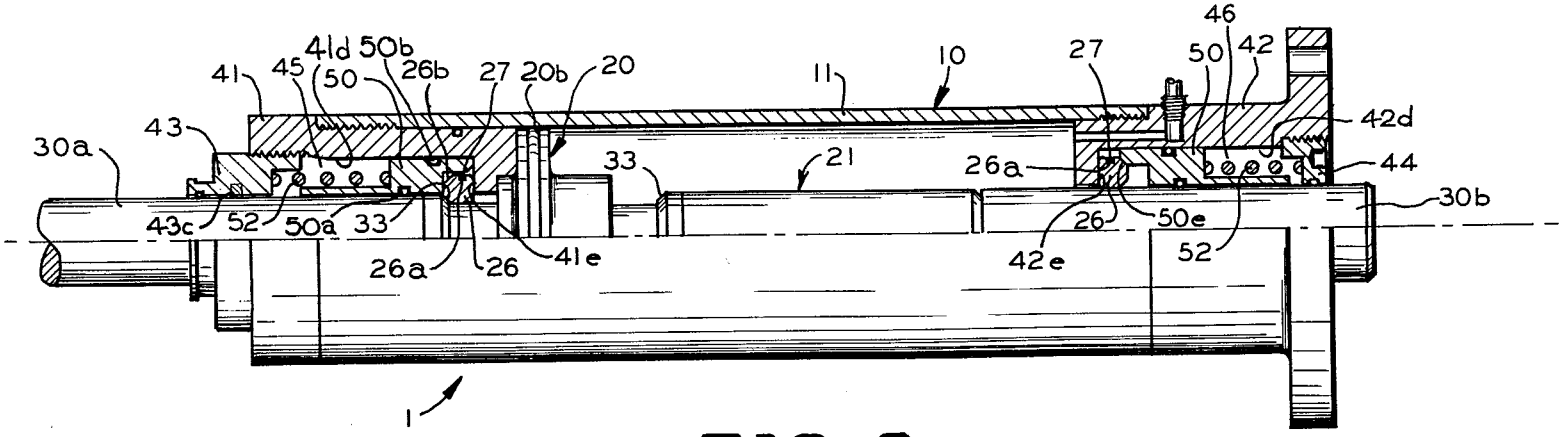
FIG. 3 is a view similar to FIG. 1 of a double acting hydraulic cylinder incorporating a modified locking mechanism in accordance with this invention.
Figure 4:
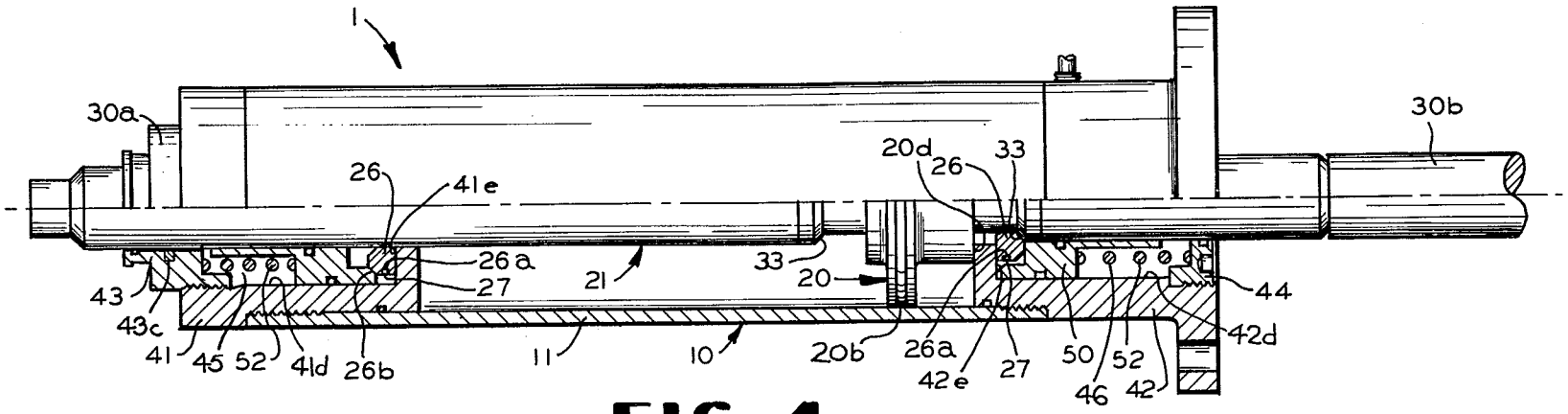
FIG. 4 is a view similar to FIG. 3 but showing the piston in the opposite axial position from that shown in FIG. 3.

Referring now to the modification disclosed in FIGS. 3 and 4, similar reference numbers refer to similar parts as described above in connection with FIGS. 1 and 2. In this modification, the annular array of locking elements comprises an annular group of locking segments 26, which are mounted in the same spaces as defined above, respectively provided between the ends of the locking pistons 50 and the adjacent face 41*e* or 42*e* of the radial internal shoulders of the end bushings 41 or 42. The segments 26 are each provided with a circumferentially extending groove 26*a* in which a tension spring 27 is mounted to provide a continuous bias urging the segments 26 to move radially inwardly. The spring, however, is not absolutely essential, for each locking segment 26 is also provided with a camming surface 26*b*, which is engaged by the inclined end surface 50*e* provided on the locking pistons 50, and the cooperation of these inclined cam surfaces will force the locking segments 26 radially inwardly into engagement with the locking shoulders 33.

The principles of this invention may be readily applied to any single acting fluid actuator wherein the piston rod of the actuator is moved by the application of fluid pressure to one extreme axial position. Only a single locking mechanism embodying this invention need by incorporated in the single acting actuator, but it will be effective, on any loss of, or significant decrease in, the control pressure applied to the actuator, to lock the single acting actuator in the position that it occupied prior to the reduction in control pressure.

Obviously, the fluid actuators may be either hydraulically or pneumatically operated.

Locking mechanisms embodying this invention find ready application for the control of relatively massive valves employed in oil wells, pipe lines and refineries. Utilization of a fluid actuator embodying the locking mechanisms of this invention will permit the particular valve to which the actuator is applied to be locked in either its open or its closed position on the occurrence of any failure in control pressure, or a significant decrease in such control pressure. Thus, a single acting fluid actuator may be locked in its "up" or open position or its "down" or closed position. If a double acting fluid actuator is employed, it will be locked in either its up or down position, depending on which position the actuator was in at the time of the occurrence of the emergency.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. In a fluid operated, double acting cylinder having a main cylinder, a piston head reciprocable therein, an actuating piston rod extending through an end wall portion of the main cylinder, and means for selectively supplying pressured fluid to said cylinder on opposite sides of said piston head to shift said piston head and rod to either of their extreme axial positions relative to the cylinder, the improvement comprising: means in said end wall portion of said main cylinder defining a secondary cylinder chamber in direct fluid communication with one end of said main cylinder; a locking piston mounted for reciprocable axial movements in said secondary cylinder chamber between a release position and a locking position, said locking piston being shiftable to said release position by pressured fluid supplied to the adjacent portions of said main cylinder; means on said piston rod defining a locking shoulder which is movable to a position adjacent said locking piston when said piston rod reaches its extreme axial position adjacent said end wall portion; freely shiftable locking means movable into locking relationship with said piston rod locking shoulder to prevent reverse movement of said piston rod from said extreme axial position; means on said locking piston for holding said locking means in locking position relative to said locking shoulder when said locking piston is in its said locking position; and means for shifting said locking piston to its said locking position whenever said locking means moves into engagement with said locking shoulder of said piston, thereby locking said piston rod in said selected extreme position, said main cylinder being provided with a second end wall portion axially spaced from the first mentioned end wall portion; means in said second end wall portion defining a tertiary cylinder chamber in direct fluid communication with the other end of said main cylinder; a second locking piston mounted for reciprocal axial movements in said tertiary chamber between a release position and a locking position; said second locking piston being shiftable to said release position by pressured fluid supplied to the adjacent portions of said main cylinder; means on said piston rod defining a second locking shoulder which is movable to a position adjacent said second locking piston when said piston rod reaches its other extreme axial position adjacent said second end wall portion; freely shiftable second locking means movable into locking relationship with said second locking shoulder to prevent reverse movement of said piston rod from its said other axial position; means on said second locking piston for holding said second locking means in locking position; and means for shifting said second locking piston to its said locking position whenever said actuating piston rod is shifted to its said other extreme axial position, thereby locking said actuating piston rod in said other extreme axial position, said secondary cylinder chamber and said tertiary cylinder chamber each having an annular configuration with said piston rod defining the inner wall thereof and said first and second locking pistons being respectively slidable on said piston rod in sealing relationship therewith.

* * * * *